US008584573B2

(12) United States Patent
Prado et al.

(10) Patent No.: US 8,584,573 B2
(45) Date of Patent: Nov. 19, 2013

(54) ORBITAL DEVICE WITH STOWABLE MOUNT

(75) Inventors: Paul Prado, Lake Forest, CA (US); Larry Lopez, Lake Forest, CA (US); Eric Beazer, Lake Forest, CA (US)

(73) Assignee: Quantum Fuel Systems Technologies Worldwide Inc., Troy, MI (US)

( * ) Notice: Subject to any disclaimer, the term of this patent is extended or adjusted under 35 U.S.C. 154(b) by 132 days.

(21) Appl. No.: 12/931,600

(22) Filed: Feb. 3, 2011

(65) Prior Publication Data

US 2011/0277622 A1 Nov. 17, 2011

Related U.S. Application Data

(60) Provisional application No. 61/301,589, filed on Feb. 4, 2010.

(51) Int. Cl.
*F41A 23/00* (2006.01)

(52) U.S. Cl.
USPC ..... 89/38; 89/37.03; 89/37.01; 89/40.03

(58) Field of Classification Search
USPC ..... 89/38, 40.03, 1.802, 37.21, 37.03, 89/40.12, 37.01, 37.02
See application file for complete search history.

(56) References Cited

U.S. PATENT DOCUMENTS 5,056,409 A * 10/1991 Allais et al. ..... 89/37.01
2010/0071540 A1* 3/2010 Cazalieres et al. ..... 89/41.01

* cited by examiner

*Primary Examiner* — Daniel J Troy
(74) *Attorney, Agent, or Firm* — Raymond Sun

(57) ABSTRACT

A weapon/recon mount device, comprising: a base ring fixable to a vehicle; a slewing ring concentric with and rotatable relative to the base ring; a pivot mount attached to the slewing ring and having a stowed state and a deployed state; and a back rest attached to the slewing ring and having a stowed state and a deployed state.

3 Claims, 9 Drawing Sheets

ORBITAL DEVICE WITH STOWABLE MOUNT

This application claims the benefit of U.S. provisional patent application Ser. No. 61/301,589 filed with the U.S. Patent and Trademark Office ("USPTO") on Feb. 4, 2010 entitled "ORBITAL DEVICE WITH STOWABLE MOUNT" the entirety of which (specification, claims, figures and abstract) is hereby incorporated by this reference as if fully set forth herein.

This disclosure was made with Government support under Contract no. N61339-03-D-0300-DO 174, awarded by National Automotive Center (NAC); Tank Automotive Research, Development and Engineering Center (TARDEC); U.S. Army. The Government has certain rights in this disclosure.

BACKGROUND

Field

This disclosure relates to combined user and device mounts on moving vehicles.

DISCLOSURE

According to some exemplary implementations, disclosed is a weapon and/or recon mount device, comprising: a base ring fixable to a vehicle; a slewing ring concentric with and rotatable relative to the base ring; a moveable mount attached to the slewing ring and having a stowed state and a deployed state. In some instances, a back rest or body support may be attached to the slewing ring.

The weapon/recon pivot mount may be substantially below the plane defined by the stewing ring while in the stowed state. The weapon/recon pivot mount may be substantially above the plane defined by the slewing ring while in the deployed state. The back rest may be substantially below the plane defined by the slewing ring while in the stowed state. The back rest may be substantially above the plane defined by the slewing ring while in the deployed state.

The weapon/recon pivot mount, which may support a plethora of weapon and recon devices, may be configured to rotate about an axis in a plane defined by the slewing ring. A rotation lock lever may be provided and configured to selectably fix the rotational orientation of the slewing ring relative to the base ring.

A back rest may be configured to rotate about an axis in a plane defined by the slewing ring. A clip may be provided and configured to secure the weapon/recon pivot mount relative to the back rest while in the stowed state. A lock knob may be provided and configured to secure the weapon/recon pivot mount relative to the slewing ring while in the deployed state.

The weapon/recon pivot mount may be configured to receive one or more of a weapon and a recon device. A second weapon/recon pivot mount may be added to the slewing ring.

The vehicle may be selected from the group consisting of: an automobile, an aircraft, a watercraft, a hovercraft, a spacecraft, and a rail-vehicle.

According to some exemplary implementations, disclosed is a method, comprising: providing at least one of a weapon/recon mount device fixed to a vehicle, the weapon/recon mount device having a weapon/recon pivot mount and a back rest, each in a stowed state; deploying the back rest to a deployed state; deploying the weapon/recon pivot mount to a deployed state; and fixing a primary weapon to the weapon/recon mount device.

According to some exemplary implementations, disclosed is a method, comprising: providing a weapon/recon mount device fixed to a vehicle, the weapon/recon mount device having a weapon/recon pivot mount and a back rest, each in a deployed state; removing a primary weapon from the weapon/recon mount device; stowing the weapon/recon pivot mount to a stowed state; and stowing the back rest to a stowed state.

Other features and advantages of the present disclosure will be set forth, in part, in the descriptions which follow and the accompanying drawings, wherein the implementations of the present disclosure are described and shown, and in part, will become apparent to those skilled in the art upon examination of the following description taken in conjunction with the accompanying drawings or may be learned by practice of the present disclosure. The advantages of the present disclosure may be realized and attained by means of the instrumentalities and combinations particularly pointed out in the disclosure and any appended claims.

DRAWINGS

The above-mentioned features and objects of the present disclosure will become more apparent with reference to the following description taken in conjunction with the accompanying drawings wherein like reference numerals denote like elements and in which.

Figure 1:
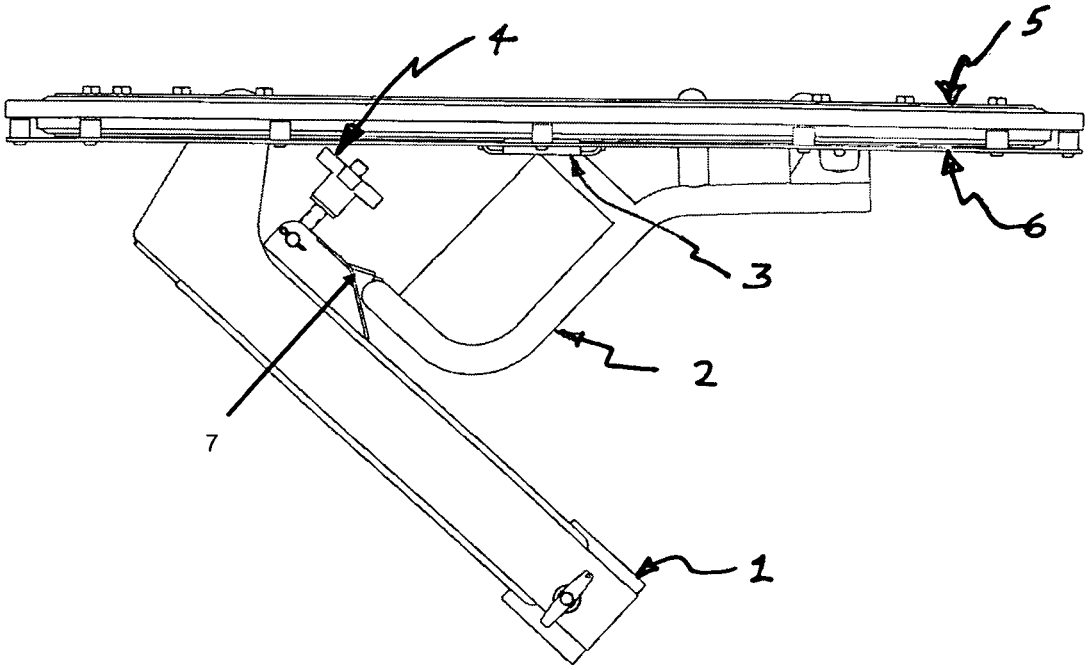
FIG. 1 shows a side view of a weapon/recon mount device in a stowed state.

It should be appreciated that for simplicity and clarity of illustration, elements shown in the Figures have not necessarily been drawn to scale. For example, the dimensions of some of the elements are exaggerated relative to each other for clarity. Further, where considered appropriate, reference numerals have been repeated among the Figures to indicate corresponding elements.

Further Disclosure

According to some exemplary implementations, a weapon/recon mount device is provided to a vehicle and configured to support one or more of a variety of associated devices.

As used herein, "weapon" refer to a gun, cannon, sound cannon, water cannon, non-lethal, light or laser emitting device or other projectile or non-projectile instrument.

As used herein, "recon" refers to communications equipment, cameras, sensors, light-emitting devices, light-receiving devices, sound-emitting devices (for communication), or a gas, light, sound, element, moisture, particulate, radiation, pollen, viral, or bacterial measuring device, etc.

As used herein, "vehicle" may refer to any structure capable of providing a platform for a weapon/recon mount device, such as any automobile, aircraft, watercraft, hovercraft, spacecraft, rail-vehicle, etc.

Figure 4:
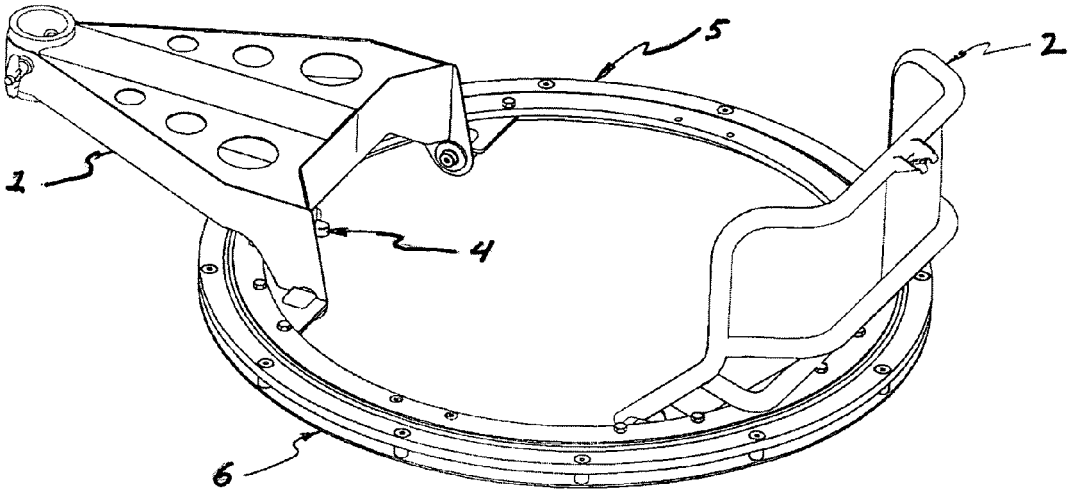
FIG. 4 shows a perspective view of a weapon/recon mount device in a deployed state.
Figure 5:
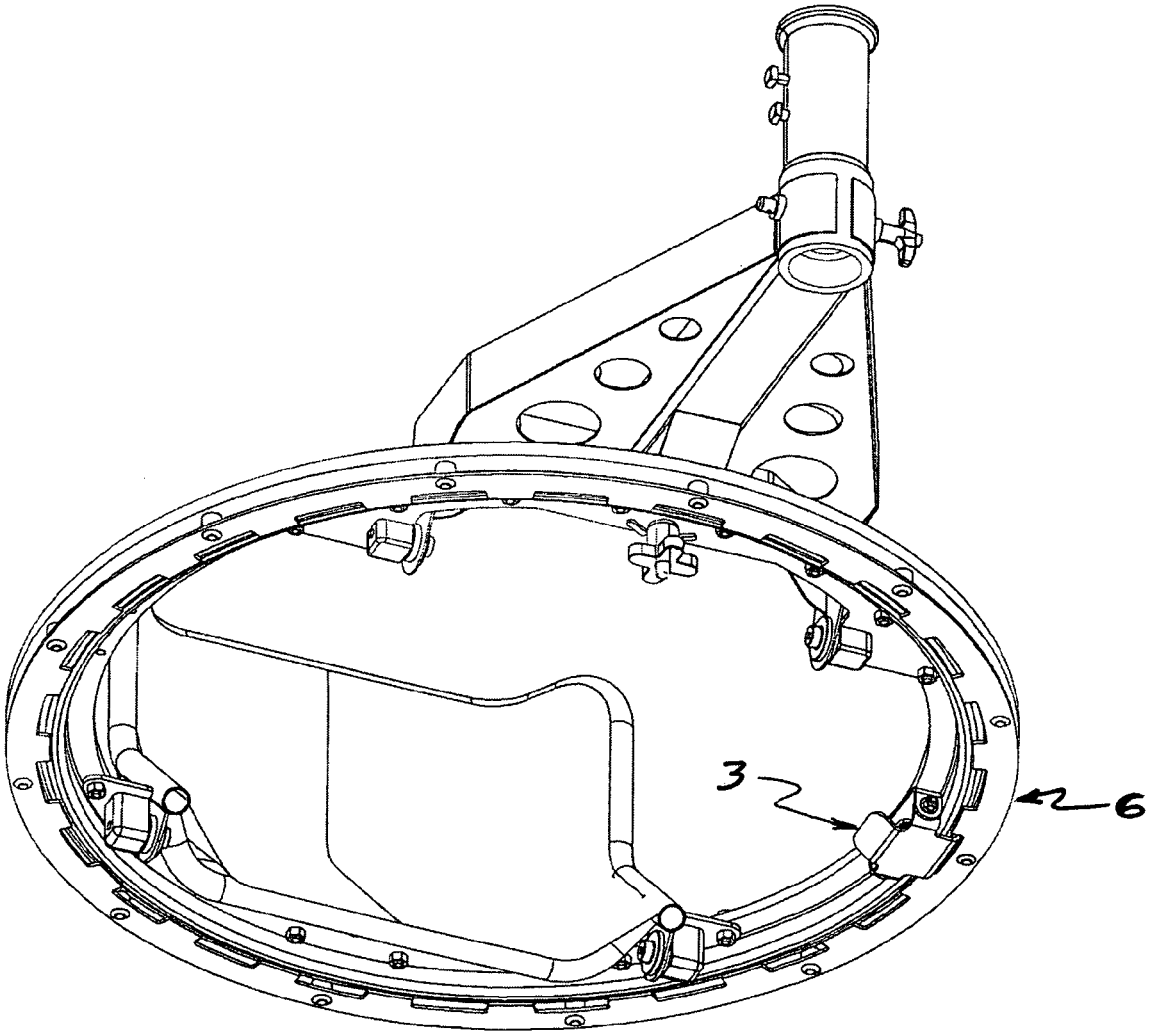
FIG. 5 shows a perspective view of a weapon/recon mount device in a deployed state.
Figure 6:
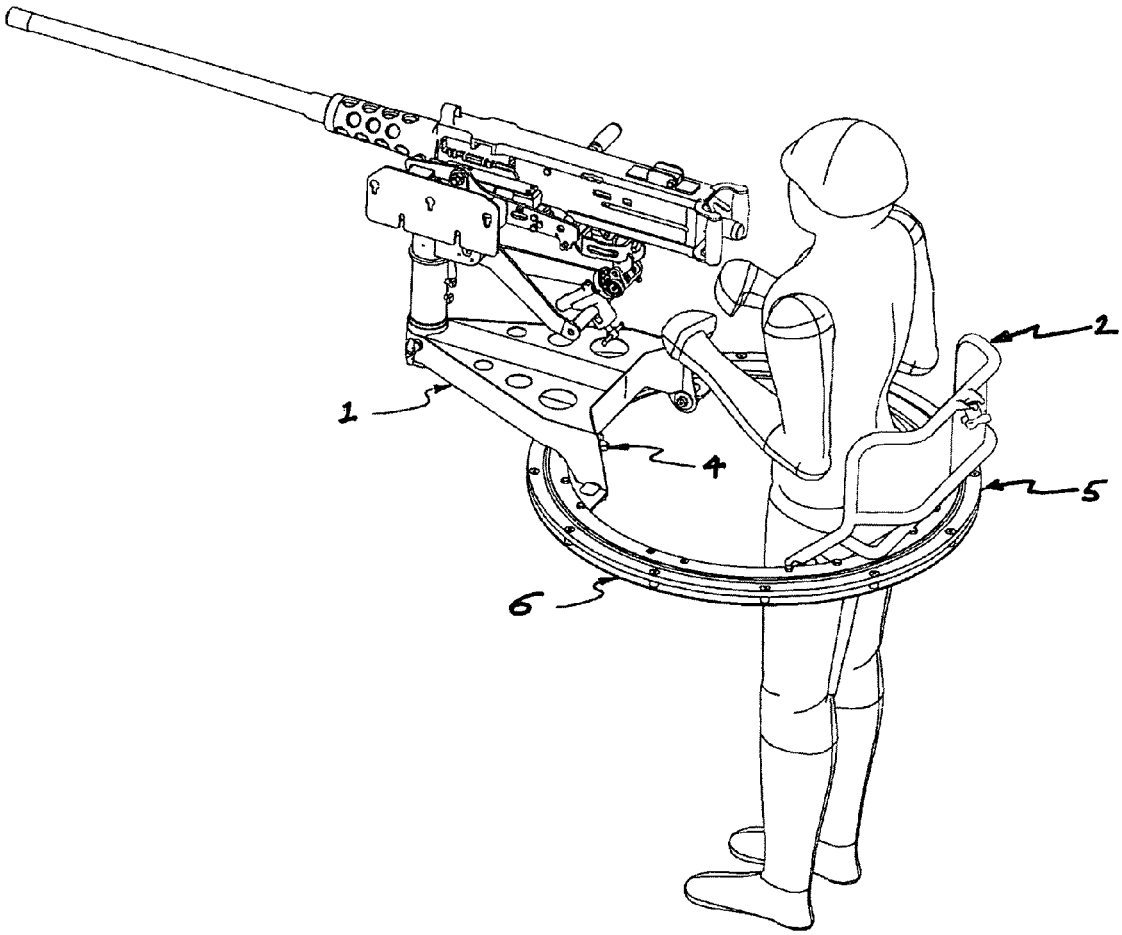
FIG. 6 shows a perspective view of a weapon/recon mount device in a deployed state.

According to some exemplary implementations, as shown in FIGS. 1, 2, 3, 4, 5, and 6, a weapon/recon mount (hereinafter the "mount") device may include pivot mount 1. As shown in FIG. 6, pivot mount 1 may support a weapon for operation with the mount device. Pivot mount 1 may be provided with any number of devices and components for interfacing with a weapon. For example, pivot mount 1 may be configured to selectably fix or control the position or orientation of a weapon relative to pivot mount 1. Pivot mount 1 may be fixably or rotatably attached to slewing ring 5, or a portion thereof.

According to some exemplary implementations, as shown in FIGS. 1, 2, 3, 4, 5, and 6, a mount device may or may not include a rear or back rest 2. As shown in FIG. 6, back rest 2 may support a portion of a user's body. Back rest 2 may be fixably or rotatably attached to slewing ring 5, or a portion thereof. Back rest 2 may be any device or structure for support, use, or interfacing with a use, such as any body support device. Body supports include but are not limited to back, thighs, arms, legs, feet, shoulders, sides and buttocks.

According to some exemplary implementations, a mount device or components thereof may separately or collectively have a stowed state and a deployed state.

Figure 2:
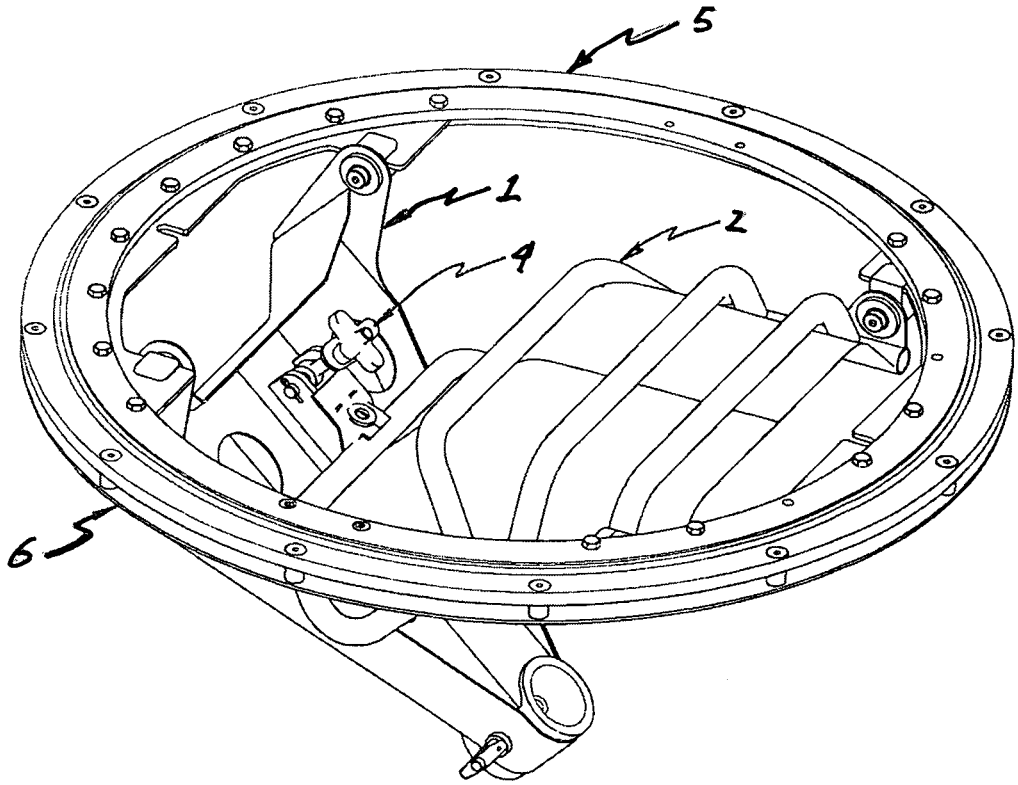
FIG. 2 shows a perspective view of a weapon/recon mount device in a stowed state.

According to some exemplary implementations, a stowed state may be identified by the position or orientation of at least one of pivot mount 1 and back rest 2 relative to slewing ring 5 or base ring 6. As shown in FIGS. 1 and 2, pivot mount 1 may be substantially below the plane defined by the slewing ring while in a stowed state. As further shown in FIGS. 1 and 2, back rest 2 may be substantially below the plane defined by the slewing ring while in a stowed state.

According to some exemplary implementations, as shown in FIGS. 1, 2, 3, 4, 5, and 6, a mount device may include clip 7. According to some exemplary implementations, as shown in FIGS. 1 and 2, clip 7 may be configured to fix the position or orientation of pivot mount 1 relative to back rest 2 while in a stowed state. For example, as shown in FIGS. 1 and 2, clip 7 may extend from a portion of pivot mount 1 and attach to at least a portion of back rest 2, whereby pivot mount 1 may be locked relative to back rest 2 and both pivot mount 1 and back rest 2 are maintained in a stowed state. According to some exemplary implementations, clip 7 may include one or more components on either or both of pivot mount 1 and back rest 2. Clip 7 may provide structure for selectably securing pivot mount 1 to back rest 2.

Figure 3:
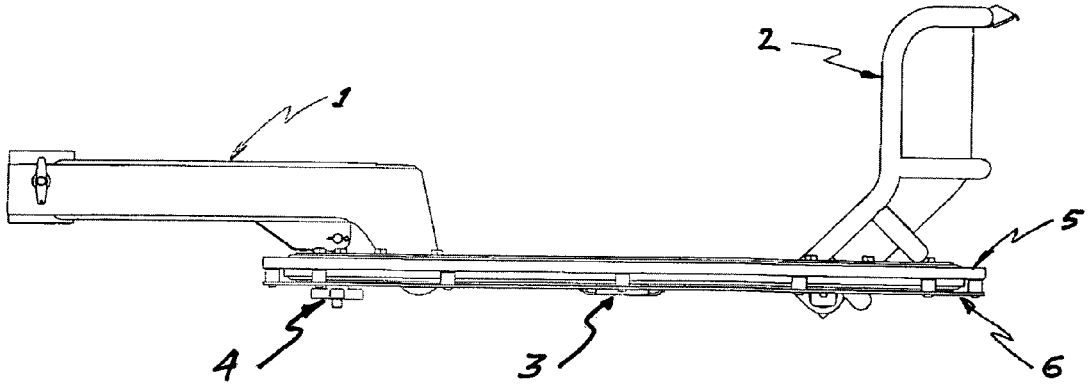
FIG. 3 shows a side view of a weapon/recon mount device in a deployed state.

According to some exemplary implementations, a deployed state may be defined by the position or orientation of at least one of pivot mount 1 and back rest 2 relative to slewing ring 5 or base ring 6. As shown in FIGS. 3 and 4, pivot mount 1 may be substantially above the plane defined by the slewing ring while in a deployed state. As further shown in FIGS. 1 and 2, back rest 2 may be substantially above the plane defined by the slewing ring while in a deployed state.

According to some exemplary implementations, as shown in FIGS. 1, 2, 3, 4, 5, and 6, a mount device may include lock knob 4. As shown in FIGS. 3 and 5, lock knob 4 may be configured to secure pivot mount 1 relative to slewing ring 5 while in a deployed state. Lock knob 4 may be any one or more of a threaded fastener, a bolt, a spring-loaded pin, a clip, a magnet, or any other structure capable of selectably fixing pivot mount 1 relative to slewing ring 5.

According to some exemplary implementations, each of pivot mount 1 and back rest 2 may transition between a stowed state and a deployed state by virtue of structures or mechanisms provided. For example, as shown in FIGS. 1, 2, 3, and 4, an interface between pivot mount 1 and slewing ring 5 may facilitate transitions as disclosed herein. Likewise, as shown in FIGS. 1, 2, 3, and 4, an interface between back rest 2 and slewing ring 5 may facilitate transitions as disclosed herein. The interfaces may include a connection that allows rotational motion about an axis of rotation (i.e., a deployment axis) for each of pivot mount 1 and back rest 2. As shown in the figures, the axis may be in or parallel to the plane of slewing ring 5, such that structure extending away from the axis may be substantially above or below the plane of slewing ring 5 based on rotation about the deployment axis. Other configurations may include spring-loaded lifts, slide mounts, extensions having multiple joints, and combinations thereof, inter alia.

According to some exemplary implementations, as shown in FIGS. 1, 2, 3, 4, 5, and 6, a mount device may include slewing ring 5 and base ring 6. According to some exemplary implementations, base ring 6 may be fixedly attached to a vehicle or other structure, such that the position and orientation of base ring 6 relative to the vehicle or other structure is fixed. Slewing ring 5 may be concentric with and rotatably attached to base ring 6, such that slewing ring 5 may slew (i.e., turn without change of place) relative to base ring 6.

According to some exemplary implementations, an interface between slewing ring 5 and base ring 6 may facilitate slewing action of slewing ring 5 relative to base ring 6. For example, a rotational rolling-element bearing, such as a slewing bearing, may be provided. An interface may be configured to support at least one of axial, radial and moment loads without disengaging bearing ring 5 from base ring 6. Those skilled in the art will recognize yet other mechanisms and structures to facilitate slewing action of slewing ring 5 relative to base ring 6.

According to some exemplary implementations, pivot mount 1 and back rest 2 may be attached to slewing ring 5, such that pivot mount 1 and back rest 2 may move with slewing ring 5 by its slewing action. As shown in FIGS. 1, 2, 3, 4, 5, and 6, each of pivot mount 1 and back rest 2 may be attached to slewing ring 5 at a distance away from a central axis of rotation of slewing ring 5 (i.e., an axis of slewing). Based on the respective locations of attachment to slewing ring 5, each of pivot mount 1 and back rest 2 may rotate about the axis of slewing along with slewing ring 5. Thus, both pivot mount 1 and back rest 2 may be simultaneously rotated about the axis of slewing by the slewing action of slewing ring 5. According to some exemplary implementations, a user may be located within slewing ring 5 and between pivot mount 1 and back rest 2. In such a configuration, the user may control the orientation of various devices, including a weapon by controlling the slewing action of slewing ring 5. Thereby, the user may have the ability to orient the weapon about a planar circle, arc, or elipse of up to a full 360°rotation by rotating slewing ring 5 about the user's body, rather than by repositioning the user's body relative to the weapon. According to some exemplary implementations, a user may effect a slewing action by applying force to pivot mount 1, back rest 2, or another structure connected to slewing ring 5.

Figure 7:
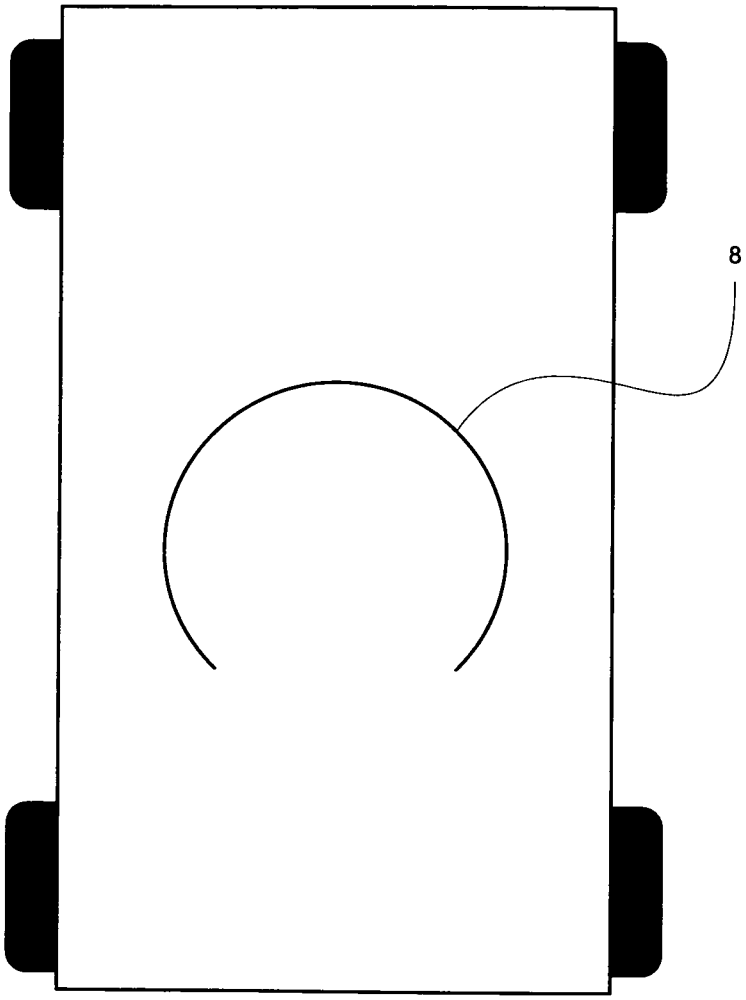
FIG. 7 shows a top view of a vehicle with partial slewing ring arc.
Figure 8:
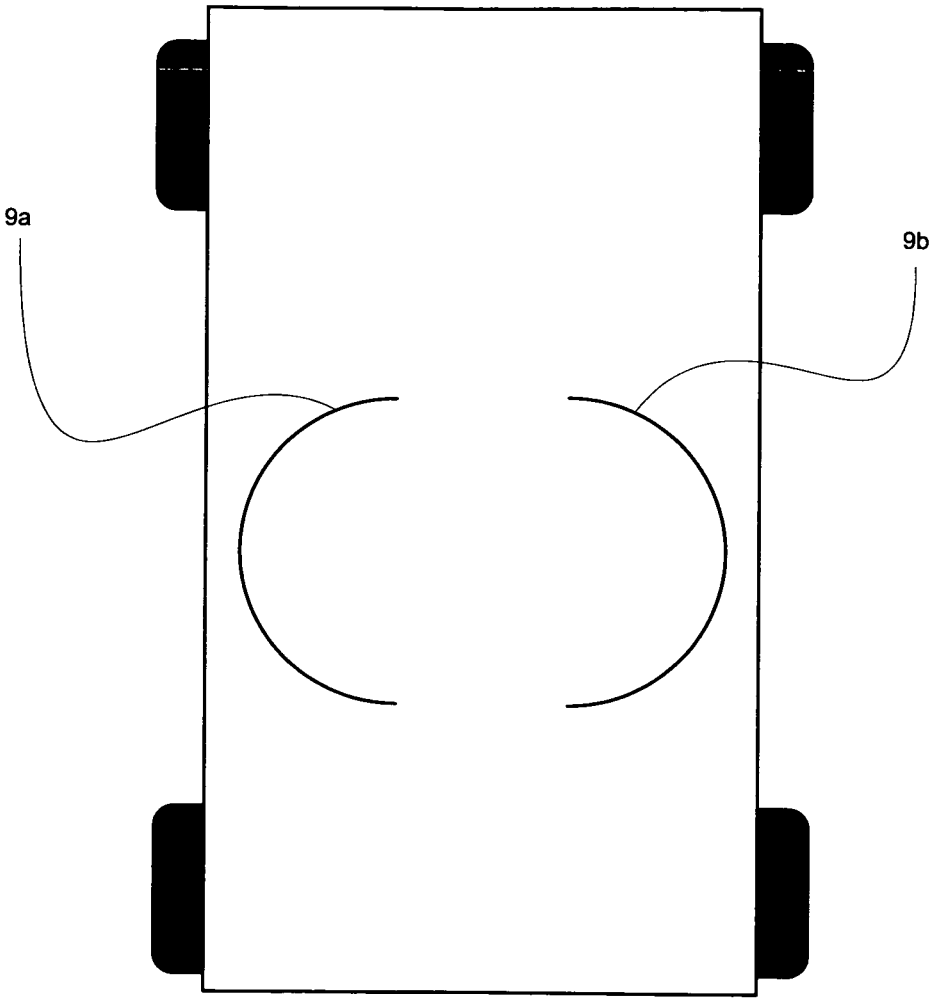
FIG. 8 shows a top view of a vehicle with a plurality of partial slewing ring arcs.
Figure 9:
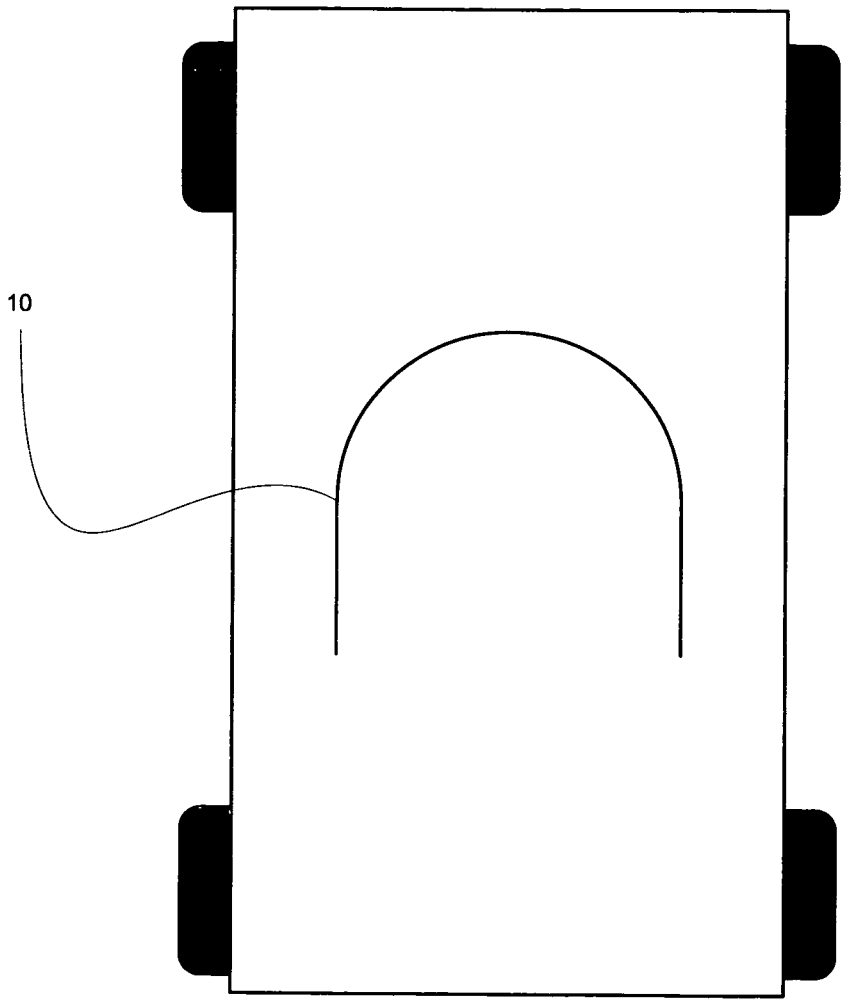
FIG. 9 shows a top view of a vehicle with partial slewing ring arc and tracks.

Those of ordinary skill will understand that slewing ring 5 may also be configured as an arc, as shown in FIGS. 7 and 8 with arcs 8, 9*a*, and 9*b*. Partial arcs or tracks 10, as shown in FIG. 9, are within the scope of this disclosure.

According to some exemplary implementations, rotation lock lever 3 may be provided to control the slewing action of slewing ring 5. For example, rotation lock lever 3 may allow a user to selectably control whether slewing ring 5 may slew or whether it is locked relative to base ring 6. Said lock lever may also function as a dampener or brake wherein it imparts a selectable resistance (which a user may overcome) to rotation or movement. An interface between slewing ring 5 and base ring 6 may provide structure to selectably enable or prevent rotation. For example, as shown in FIG. 5, rotation lock lever 3 may be configured to selectably lock onto one of a number of notches about base ring 6. The slewing action of slewing ring 5 may likewise be facilitated or prevented by automated or controllable mechanisms. According to some exemplary implementations, rotation lock lever 3 may prevent torque applied to slewing ring 5 by operation of a weapon from undesirably rotating slewing ring 5.

According to some exemplary implementations, pivot mount 1 may facilitate rotational motion for a weapon mounted thereon independent of the slewing action of slewing ring 5. For example, a weapon mounted to pivot mount 1 may rotate about at least one axis relative to pivot mount 1 (i.e., an aiming axis).

According to some exemplary implementations, a mount device of the present disclosure may be provided to a vehicle. When in a stowed state, components of the mount device may each be substantially within the vehicle. This may allow the components to be protected from exposure or damage. Likewise, surrounding structures and materials may be spared from damage that could be inflicted by components that would otherwise be extending from the mount device.

According to some exemplary implementations, additional space outside the vehicle may be made available while in a stowed state. Thus, the vehicle may be made more compact by providing a mount device in a stowed state. For example, during storage or transport of the vehicle, the space outside preserved while in a stowed state may be used for other purposes.

According to some exemplary implementations, a mount device of the present disclosure may transition from a stowed state to a deployed state in a short period of time. For example, a mount device may be ready for use by deploying back rest 2 to a deployed state; deploying pivot mount 1 to a deployed state; and fixing a weapon to the mount device (e.g., to pivot mount 1).

According to some exemplary implementations, a mount device of the present disclosure may transition from a deployed state to a stowed state in a short period of time. For example, a mount device may be ready for compact storage or transport by removing a weapon from the mount device (e.g., from pivot mount 1); stowing pivot mount 1 to a stowed state; and stowing back rest 2 to a stowed state.

While the method and agent have been described in terms of what are presently considered to be the most practical and preferred implementations, it is to be understood that the disclosure need not be limited to the disclosed exemplary implementations. It is intended to cover various modifications and similar arrangements included within the spirit and scope of the claims, the scope of which should be accorded the broadest interpretation so as to encompass all such modifications and similar structures. The present disclosure includes any and all of the following claims.

It should also be understood that a variety of changes may be made without departing from the essence of the disclosure. Such changes are also implicitly included in the description. They still fall within the scope of this invention. It should be understood that this disclosure is intended to yield a patent covering numerous aspects of the disclosure both independently and as an overall system and in both method and apparatus modes.

Further, each of the various elements of the disclosure and claims may also be achieved in a variety of manners. This disclosure should be understood to encompass each such variation, be it a variation of an implementations or aspects thereof of any apparatus implementation or exemplar, a method or process embodiment, or even merely a variation of any element of these.

Particularly, it should be understood that as the disclosure relates to elements of the exemplars, the words for each element may be expressed by equivalent apparatus terms or method terms—even if only the function or result is the same.

Such equivalent, broader, or even more generic terms should be considered to be encompassed in the description of each element or action. Such terms can be substituted where desired to make explicit the implicitly broad coverage to which this invention is entitled.

It should be understood that all actions may be expressed as a means for taking that action or as an element which causes that action.

Similarly, each physical element disclosed should be understood to encompass a disclosure of the action which that physical element facilitates.

Any patents, publications, or other references mentioned in this application for patent are hereby incorporated by reference. In addition, as to each term used it should be understood that unless its utilization in this application is inconsistent with such interpretation, common dictionary definitions should be understood as incorporated for each term and all definitions, alternative terms, and synonyms such as contained in at least one of a standard technical dictionary recognized by artisans and the Random House Webster's Unabridged Dictionary, latest edition are hereby incorporated by reference.

Finally, all referenced listed in the Information Disclosure Statement or other information statement filed with the application are hereby appended and hereby incorporated by reference; however, as to each of the above, to the extent that such information or statements incorporated by reference might be considered inconsistent with the patenting of this/these invention(s), such statements are expressly not to be considered as made by the applicant(s).

In this regard it should be understood that for practical reasons and so as to avoid adding potentially hundreds of claims, the applicant has presented claims with initial dependencies only.

Support should be understood to exist to the degree required under new matter laws—including but not limited to United States Patent Law 35 USC 132 or other such laws—to permit the addition of any of the various dependencies or other elements presented under one independent claim or concept as dependencies or elements under any other independent claim or concept.

To the extent that insubstantial substitutes are made, to the extent that the applicant did not in fact draft any claim so as to literally encompass any particular embodiment, and to the extent otherwise applicable, the applicant should not be understood to have in any way intended to or actually relinquished such coverage as the applicant simply may not have been able to anticipate all eventualities; one skilled in the art, should not be reasonably expected to have drafted a claim that would have literally encompassed such alternative embodiments.

Further, the use of the transitional phrase "comprising" is used to maintain the "open-end" claims herein, according to traditional claim interpretation. Thus, unless the context requires otherwise, it should be understood that the term "compromise" or variations such as "comprises" or "comprising", are intended to imply the inclusion of a stated element or step or group of elements or steps but not the exclusion of any other element or step or group of elements or steps.

Such terms should be interpreted in their most expansive forms so as to afford the applicant the broadest coverage legally permissible.

The invention claimed is:

1. A method, comprising:

providing a slewing ring rotatably attached about an opening on top of a vehicle;

pivotally mounting a weapon/recon mount to said slewing ring;

pivotally mounting a back rest to the slewing opposed to said weapon/recon mount;

pivoting said weapon/recon mount from a stowed state inside the vehicle to a deployed state outside the vehicle;

fixing a primary weapon to said weapon/recon mount while in the deployed state;

pivoting said back rest from a stowed state inside the vehicle to a deployed state outside the vehicle independently of the weapon/recon mount position;

and wherein the back rest is configured to support a portion of a user's body when the user is positioned in the opening.

2. The method of claim 1, further comprising rotating the weapon/recon mount relative to the vehicle.

3. The method of claim 1, further comprising securing the weapon/recon mount in a deployed state.

* * * * *